US009019188B2

(12) United States Patent
Han et al.

(10) Patent No.: US 9,019,188 B2
(45) Date of Patent: Apr. 28, 2015

(54) DISPLAY DEVICE FOR VARYING DIFFERENT SCAN RATIOS FOR DISPLAYING MOVING AND STILL IMAGES AND A DRIVING METHOD THEREOF

(75) Inventors: Young-Su Han, Incheon (KR); Seung Hwan Moon, Asan-si (KR); Jung Hwan Cho, Asan-si (KR); Myeong-Su Kim, Cheonan-si (KR); Jae Wan Park, Seoul (KR); Jin-Soo Kim, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 292 days.

(21) Appl. No.: 13/410,605

(22) Filed: Mar. 2, 2012

(65) Prior Publication Data

US 2013/0038639 A1 Feb. 14, 2013

(30) Foreign Application Priority Data

Aug. 8, 2011 (KR) ..... 10-2011-0078796

(51) Int. Cl.
*G09G 3/36* (2006.01)
*G09G 3/20* (2006.01)

(52) U.S. Cl.
CPC ..... *G09G 3/20* (2013.01); *G09G 2320/0673* (2013.01); *G09G 2320/103* (2013.01); *G09G 2330/021* (2013.01); *G09G 2340/0435* (2013.01)
USPC ..... 345/99

(58) Field of Classification Search
CPC ..... G09G 2320/0276
USPC ..... 345/690, 89, 99
See application file for complete search history.

(56) References Cited

U.S. PATENT DOCUMENTS

| | | | | |
|---|---|---|---|---|
| 6,005,542 | A | 12/1999 | Yoon | |
| 7,102,604 | B2 | 9/2006 | Hong | |
| 7,112,996 | B2 | 9/2006 | Lee | |
| 7,362,295 | B2 | 4/2008 | Park et al. | |
| 7,489,295 | B2 | 2/2009 | Honbo | |
| 7,545,354 | B2 | 6/2009 | Ha et al. | |
| 7,545,654 | B2 | 6/2009 | Berghegger | |
| 7,580,032 | B2 | 8/2009 | Jung et al. | |
| 7,612,505 | B2 | 11/2009 | Min et al. | |
| 7,724,218 | B2 | 5/2010 | Kim et al. | |
| 7,907,106 | B2 | 3/2011 | Shin et al. | |
| 8,692,823 | B2 | 4/2014 | Toyotaka et al. | |
| 2001/0024187 | A1 * | 9/2001 | Sato et al. | 345/98 |
| 2002/0067332 | A1 | 6/2002 | Hirakata et al. | |
| 2003/0030607 | A1 * | 2/2003 | Kitagawa et al. | 345/87 |
| 2004/0169627 | A1 | 9/2004 | Hong | |

(Continued)

FOREIGN PATENT DOCUMENTS

| | | |
|---|---|---|
| EP | 0838801 | 4/1998 |
| JP | 06-267660 | 9/1994 |

(Continued)

*Primary Examiner* — Long D Pham
(74) *Attorney, Agent, or Firm* — F. Chau & Associates, LLC

(57) ABSTRACT

A display device including a display panel displaying a still image and a moving image and a signal controller controlling signals to drive the display panel, wherein the signal controller includes a frame memory storing image data of the still image and providing the image data to the display panel, and the display panel is driven with a first scan ratio when displaying the moving image and is driven with a second scan ratio that is lower than the first scan ratio when displaying the still image.

15 Claims, 6 Drawing Sheets

(56) References Cited

U.S. PATENT DOCUMENTS

| | | | | |
|---|---|---|---|---|
| 2004/0179002 | A1 | 9/2004 | Park et al. | |
| 2005/0068289 | A1 | 3/2005 | Diefenbaugh et al. | |
| 2005/0253798 | A1* | 11/2005 | Hiyama et al. | 345/98 |
| 2006/0038771 | A1 | 2/2006 | Hirakata et al. | |
| 2007/0091204 | A1* | 4/2007 | Koshimizu et al. | 348/441 |
| 2007/0103424 | A1 | 5/2007 | Huang | |
| 2007/0132683 | A1* | 6/2007 | Kong | 345/87 |
| 2007/0139427 | A1 | 6/2007 | Sahashi | |
| 2007/0176883 | A1 | 8/2007 | Hsu et al. | |
| 2008/0079701 | A1 | 4/2008 | Shin et al. | |
| 2008/0084379 | A1 | 4/2008 | Takahashi et al. | |
| 2008/0100553 | A1* | 5/2008 | Shen et al. | 345/89 |
| 2008/0224983 | A1 | 9/2008 | Lee et al. | |
| 2009/0096769 | A1 | 4/2009 | Kim et al. | |
| 2009/0244112 | A1 | 10/2009 | Jung et al. | |
| 2010/0165145 | A1 | 7/2010 | Kuroki | |
| 2010/0238193 | A1 | 9/2010 | Neal et al. | |
| 2010/0302265 | A1 | 12/2010 | Sumi | |
| 2011/0025910 | A1 | 2/2011 | Furukawa et al. | |
| 2011/0148826 | A1 | 6/2011 | Koyama et al. | |
| 2011/0157253 | A1* | 6/2011 | Yamazaki et al. | 345/690 |
| 2011/0227955 | A1 | 9/2011 | Lee et al. | |
| 2012/0268446 | A1 | 10/2012 | Yamauchi | |
| 2012/0320004 | A1 | 12/2012 | Kitakado | |
| 2013/0027379 | A1 | 1/2013 | Lee et al. | |

FOREIGN PATENT DOCUMENTS

| | | |
|---|---|---|
| JP | 06-333695 | 12/1994 |
| JP | 07-191298 | 7/1995 |
| JP | 09-101506 | 4/1997 |
| JP | 10-111490 | 4/1998 |
| JP | 2001-013930 | 1/2001 |
| JP | 2004-061782 | 2/2004 |
| JP | 2005-091385 | 4/2005 |
| JP | 2005-234032 | 9/2005 |
| JP | 3718832 | 9/2005 |
| JP | 2006-073199 | 3/2006 |
| JP | 2006-091242 | 4/2006 |
| JP | 2006-228312 | 8/2006 |
| JP | 2007-039759 | 2/2007 |
| JP | 2007-267038 | 10/2007 |
| JP | 2008-098710 | 4/2008 |
| JP | 2009-069373 | 4/2009 |
| JP | 2009-075580 | 4/2009 |
| JP | 2010-066725 | 3/2010 |
| JP | 4469788 | 3/2010 |
| JP | 4586052 | 9/2010 |
| JP | 2010-273259 | 12/2010 |
| KR | 10-2002-0072504 | 9/2002 |
| KR | 10-0374375 | 2/2003 |
| KR | 10-0400595 | 9/2003 |
| KR | 10-0480815 | 3/2005 |
| KR | 10-2006-0058421 | 5/2006 |
| KR | 10-2006-0066424 | 6/2006 |
| KR | 10-2007-0039759 | 4/2007 |
| KR | 10-2007-0066013 | 6/2007 |
| KR | 1020070076078 | 7/2007 |
| KR | 10-0770543 | 10/2007 |
| KR | 100767868 | 10/2007 |
| KR | 1020080002427 | 1/2008 |
| KR | 10-2008-0035333 | 4/2008 |
| KR | 10-0834119 | 5/2008 |
| KR | 10-0840331 | 6/2008 |
| KR | 10-0848953 | 7/2008 |
| KR | 1020100131671 | 12/2010 |
| KR | 10-2011-0070178 | 6/2011 |
| KR | 1020130012381 | 2/2013 |

* cited by examiner

DISPLAY DEVICE FOR VARYING DIFFERENT SCAN RATIOS FOR DISPLAYING MOVING AND STILL IMAGES AND A DRIVING METHOD THEREOF

CROSS-REFERENCE TO RELATED APPLICATION

This application claims priority under 35 U.S.C. §119 to Korean Patent Application No. 10-2011-0078796 filed in the Korean Intellectual Property Office on Aug. 8, 2011, the disclosure of which is incorporated by reference herein in its entirety.

BACKGROUND

1. Technical Field

The present invention relates to a display device and a driving method thereof. More particularly, the present invention relates to a driving method that reduces power consumption and that prevents deterioration of visibility in a display device, and a display device employing the driving method.

2. Discussion of the Related Art

Computer monitors, televisions, mobile phones, and the like are or include display devices. Example display device types include a cathode ray tube display, a liquid crystal display, and a plasma display.

The display device may include a graphics processing unit (GPU), a display panel, and a signal controller. The GPU transmits image data to be displayed by the display panel to the signal controller, and the signal controller generates a control signal to drive the display panel and transmits the control signal along with the image data to the display panel, thereby driving the display device to display an image.

The image displayed by the display panel is generally divided into a still image and a moving image. A still image is displayed when the display panel displays several frames per second, and the image data of each frame is the same, for example. A moving image is displayed when the display panel displays several frames per second, and the image data of each frame are different from each other, for example.

In the still image case, the signal controller receives the same image data from the GPU for every frame the still image is displayed, thereby increasing power consumption of the display device.

To reduce the power consumption of the display device, a frame memory has been added to the signal controller to store the image data of the still image, and the stored image data is provided to the display panel while the still image is displayed. This is referred to as a pixel self refresh (PSR) technique. In the PSR technique, the image data is not transmitted from the GPU while the still image is displayed such that the GPU is not activated, thereby reducing the power consumption.

However, when the display device is driven with the PSR technique, the frame memory is added such that the power consumption is increased. Accordingly, there exists a need to reduce power consumed by a display device.

SUMMARY

The present invention provides a driving method that reduces power consumption and that prevents deterioration of visibility in a display device, and a display device including the driving method.

A display device according to an exemplary embodiment of the present invention includes: a display panel displaying a still image and a moving image; and a signal controller controlling signals to drive the display panel, wherein the signal controller includes a frame memory storing image data of the still image and providing the image data to the display panel, and the display panel is driven with a first scan ratio when displaying the moving image and is driven with a second scan ratio that is lower than the first scan ratio when displaying the still image.

The display device may further include a graphics processing unit transmitting image data of the moving image to the signal controller when the moving image is displayed, and transmitting a still image start signal and a still image finish signal to the signal controller.

The display panel may be driven with the second scan ratio in response to the still image start signal until a frame in which the still image finish signal is applied ends.

The display panel may include a gate line and a data line, the display device may further include a gate driver driving the gate line, and a data driver driving the data line, and the signal controller may transmit a scanning start (STV) signal and a gate clock (CPV) signal to the gate driver.

The signal controller may transmit the STV signal to the gate driver at the start of each frame except for a frame where the second scan ratio is changed to the first scan ratio.

A first clock signal, which is used when the display panel is driven with the second scan ratio, may have a lower clock speed than a second clock signal, which is used when the display panel is driven with the first scan ratio.

The clock signal, which is used when the display panel is driven with the second scan ratio, may have a longer blank period than the second clock signal, which is used when the display panel is driven with the first scan ratio.

The signal controller may control a width of the CPV signal to be the same when the display panel is driven with the first scan ratio and the second scan ratio.

The signal controller may control the width of the CPV signal to have the same width as a clock signal of n pulses when the display panel is driven with the first scan ratio, and the width of the CPV signal to have the same width as a clock signal of m pulses, which is less than the n pulses, when the display panel is driven with the second scan ratio.

The signal controller may gamma-correct the image data of the still image when the display panel is driven with the second scan ratio and may transmit the gamma-corrected image data to the display panel.

A method for driving a display device including a display panel displaying a moving image and a still image, and a signal controller controlling signals to drive the display panel, the method includes: displaying, at the display panel, the moving image with a first scan ratio; receiving, at the signal controller, a still image start signal and image data of a still image and storing the image data of the still image in a frame memory of the signal controller; supplying, in response to the still image start signal, the image data of the still image stored in the frame memory to the display panel; and displaying, at the display panel, the still image with a second scan ratio that is lower than the first scan ratio.

The method may further include: displaying the still image with the second scan ratio at the display panel until a frame in which a still image finish signal is applied ends; and displaying the moving image with the first scan ratio at the display panel in a frame following the frame in which the still image finish signal is applied.

The method may further include: transmitting, from a graphics processing unit of the display device, image data of the moving image to the signal controller when the moving image is displayed, and deactivating the graphics processing unit when the still image is displayed.

The method may further include: transmitting, from the signal controller, an STV signal at the start of each frame except for a first frame to be driven with the first scan ratio after the still image finish signal is applied.

The method may further include: outputting, from the signal controller, a first clock signal when the display panel is driven with the second scan ratio and a second clock signal when the display panel is driven with the first scan ratio, wherein the first clock signal has a lower speed than the second clock signal.

The method may further include: outputting, from the signal controller, a first clock signal when the display panel is driven with the second scan ratio and a second clock signal when the display panel is driven with the first scan ratio, wherein the first clock signal has a longer blank period than the second clock signal.

The method may further include: controlling, with the signal controller, a width of the CPV signal to be the same when the display panel is driven with the second scan ratio and when the display panel is driven with the first scan ratio.

The signal controller may control the width of the CPV signal to have the same width as a clock signal of n pulses when the display panel is driven with the first scan ratio, and the width of the CPV signal to have the same width as a clock signal of m pulses, which is less than the n pulses, when the display panel is driven with the second scan ratio.

The method may further include: gamma-correcting, with the signal controller, the image data of the still image when the display panel is driven with the second scan ratio, and transmitting the gamma-corrected image data to the display panel.

A display device according to an exemplary embodiment of the present invention includes: a display panel that displays a still image and a moving image; a signal controller that drives the display panel and includes a frame memory that stores image data of the still image; and a graphics processing unit (GPU) that provides the image data of the still image at a first frame rate to the signal controller and provides image data of the moving image at a second frame rate to the signal controller, wherein, in a first frame in which the GPU switches from the first frame rate to the second frame rate, the image data of the still image is displayed to the end of the first frame.

In a second frame that occurs after the first frame, a scanning start signal is not output from the signal controller to maintain the display of the image data of the still image in the second frame.

DETAILED DESCRIPTION OF THE EMBODIMENTS

Figure 1:
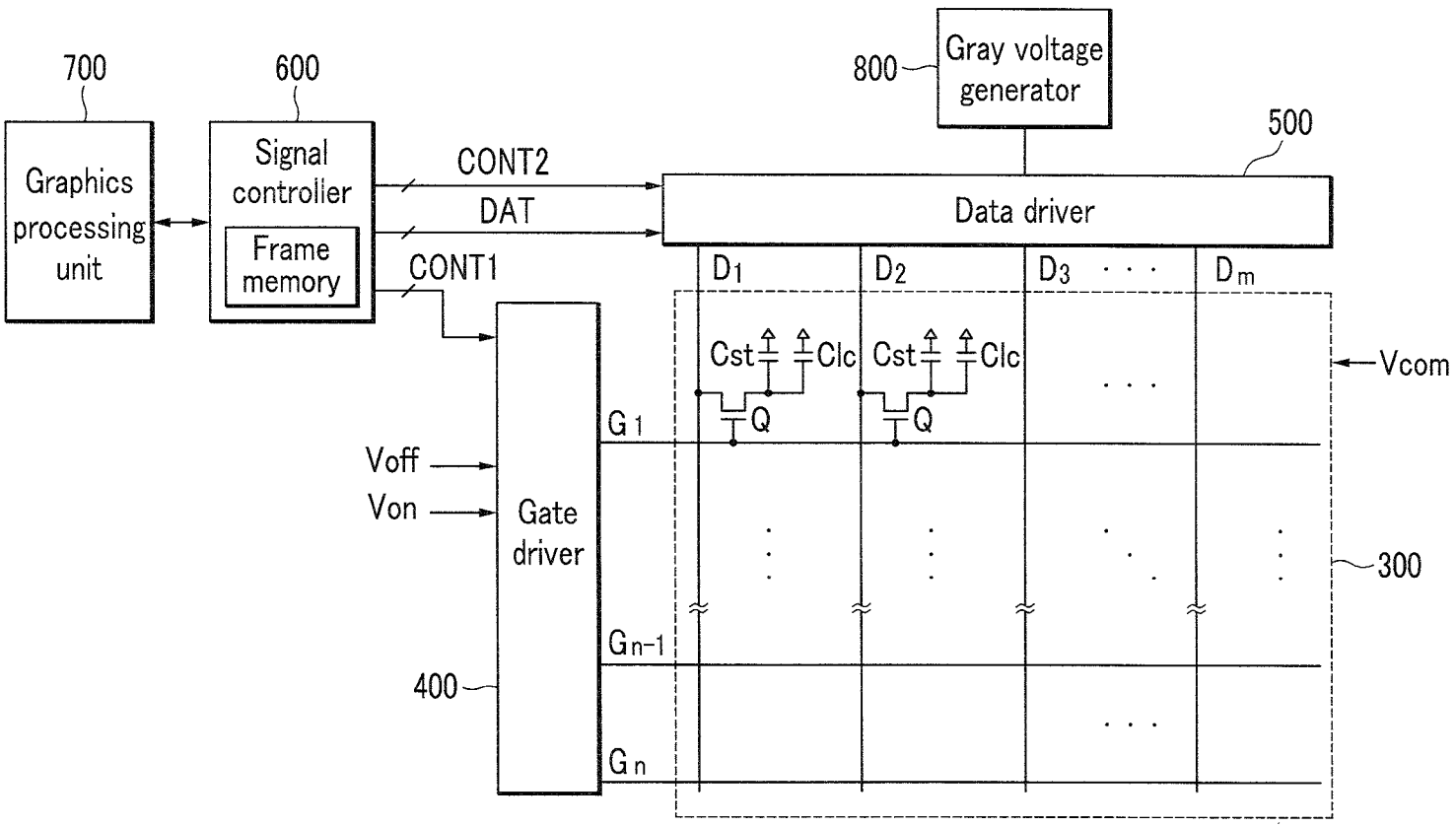
FIG. 1 is a block diagram of a display device according to an exemplary embodiment of the present invention.

Exemplary embodiments of the present invention will be described more fully hereinafter with reference to the accompanying drawings. However, the present invention may be embodied in various different ways and should not be construed as limited to the exemplary embodiments disclosed herein.

Like reference numerals may designate like elements throughout the specification and drawings.

First, a display device according to an exemplary embodiment of the present invention will be described with reference to FIG. 1.

FIG. 1 is a block diagram of a display device according to an exemplary embodiment of the present invention.

As shown in FIG. 1, a display device according to an exemplary embodiment of the present invention includes a display panel 300 for displaying an image and a signal controller 600 for controlling signals to drive the display panel 300.

The display panel 300 may display a still image and a moving image. If image data are the same in a plurality of continuous frames, a still image is displayed, and if image data are different in a plurality of continuous frames, a moving image is displayed.

The display panel 300 includes a plurality of gate lines G1-Gn and a plurality of data lines D1-Dm, wherein the plurality of gate lines G1-Gn extend in a horizontal direction, and the plurality of data lines D1-Dm intersect the plurality of gate lines G1-Gn and extend in a vertical direction.

A pixel is connected to one of the gate lines G1-Gn and one of the data lines D1-Dm, and the pixel includes a switching element Q connected to the gate line and the data line. The switching element Q includes a control terminal connected to the gate line, an input terminal connected to the data line, and an output terminal connected to a liquid crystal capacitor $C_{LC}$ and a storage capacitor $C_{ST}$.

The display panel 300 of FIG. 1 is a liquid crystal panel, however the display panel 300 to which the present invention may be applied may include various display panels such as an organic light emitting diode display panel, an electrophoretic display panel, and a plasma display panel.

The signal controller 600 includes a frame memory for storing image data DAT of the still image.

The display device according to an exemplary embodiment of the present invention may further include a graphics processing unit 700, and the graphics processing unit 700 transmits the image data DAT of each frame to be displayed by the display panel 300 to the signal controller 600.

When the display panel 300 displays the moving image, the graphics processing unit 700 transmits the image data DAT to the signal controller 600 every each frame.

When the display panel 300 displays the still image, the signal controller 600 receives the image data DAT of the still image from the graphics processing unit 700 and stores the image data DAT of the still image in the frame memory. The signal controller 600 deactivates the graphics processing unit 700 such that the graphics processing unit 700 does not transmit the image data DAT of the still image every frame. In other words, when the display panel 300 displays the still image, the transmission of the image data DAT of the still image from the graphics processing unit 700 is stopped, and the display panel 300 is driven by using the image data DAT of the still image stored in the frame memory.

The signal controller 600 processes the image data DAT and a control signal to be suitable for the operating conditions of the display panel 300 in response to the image data DAT and the control signal input from the graphics processing unit 700, and generates and outputs a gate control signal CONT1 and a data control signal CONT2. The control signal output from the graphics processing unit 700 may be a vertical synchronization signal Vsync, a horizontal synchronization signal Hsync, a main clock signal MCLK, and a data enable signal DE.

The gate control signal CONT1 includes a scanning start signal STV (hereinafter referred to as "STV signal") for instructing an output start of a gate-on pulse (e.g., a high period of a gate signal) and a gate clock signal CPV (hereinafter referred to as "CPV signal") for instructing an output period of the gate-on pulse.

The data control signal CONT2 further includes a horizontal synchronization start signal STH for instructing an input start of the image data DAT and a load signal TP for applying a corresponding data voltage to the data lines D1-Dm.

The display device according to an exemplary embodiment of the present invention may further include a gate driver 400 for driving the gate lines G1-Gn and a data driver 500 for driving the data lines D1-Dm.

A plurality of the gate lines G1-Gn of the display panel 300 are connected to the gate driver 400, and the gate driver 400 alternately applies a gate-on voltage Von and a gate-off voltage Voff to the gate lines G1-Gn according to the gate control signal CONT1 applied from the signal controller 600.

A plurality of the data lines D1-Dm of the display panel 300 are connected to the data driver 500, and the data driver 500 receives the data control signal CONT2 and the image data DAT from the signal controller 600. The data driver 500 converts the image data DAT into data voltages by using a gray voltage generated in a gray voltage generator 800, which is included in the display device according to an exemplary embodiment of the present invention, and transmits the data voltages to the data lines D1-Dm.

The display device according to an exemplary embodiment of the present invention is driven with a first scan ratio (e.g., a first frame rate) when the display panel 300 displays a moving image, and is driven with a second scan ratio (e.g., a second frame rate) when the display panel 300 displays the still image. Here, the second scan ratio is lower than the first scan ratio.

For example, when displaying the moving image, 60 frames are displayed during one second on a screen of the display panel 300, and when displaying the still image, 40 frames are displayed during one second on the screen. In this case, the power consumption of the display device according to an exemplary embodiment of the present invention is decreased by two thirds when displaying the still image as compared to when displaying the moving image. Accordingly, the scan ratio when displaying the still image is set to be lower than the scan ratio when displaying the moving image by a predetermined ratio, and thus, the decrease in the amount of power consumption outweighs the increase in the amount of the power consumption due to the addition of the frame memory.

When displaying the moving image, if the scan ratio is low, the motion may not appear seamless; however, since the frame having the image data DAT of the still image is repeated and displayed when displaying the still image the image appears still, although the scan ratio is low. However, when the scan ratio is decreased, flicker is increased such that it may be preferable to decrease the scan ratio to a degree that flicker does not appear.

Next, a driving method of a display device according to an exemplary embodiment of the present invention will be described with reference to FIG. 1 and FIG. 2.

Figure 2:
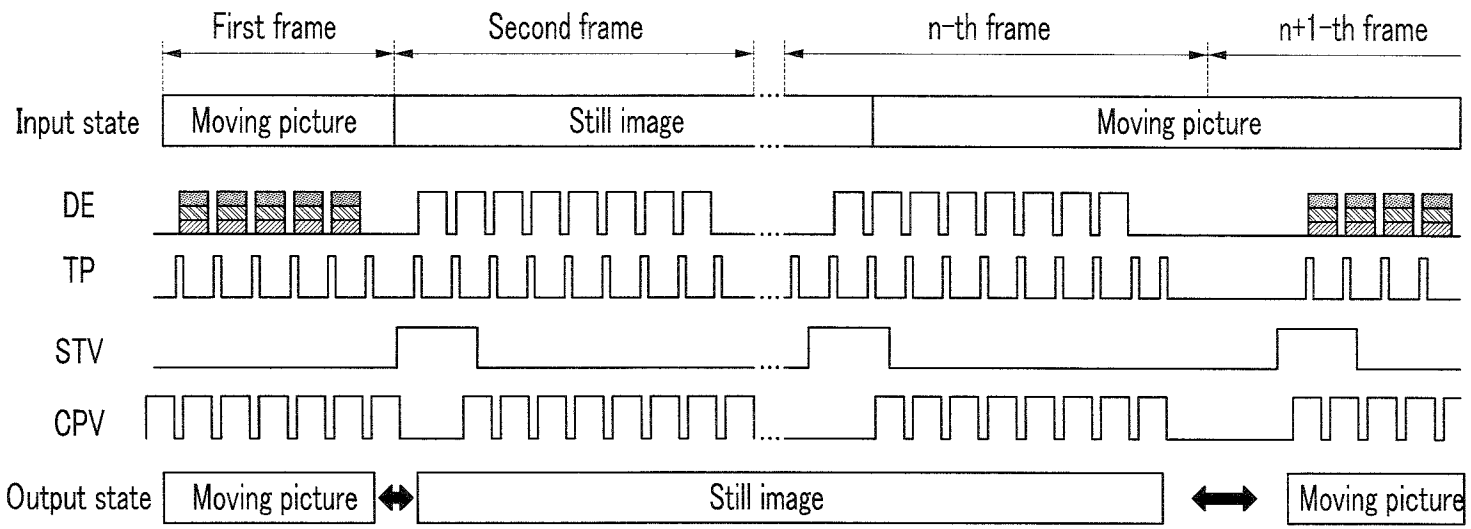
FIG. 2 is a timing diagram of control signals of a display device according to an exemplary embodiment of the present invention.

FIG. 2 is a timing diagram of control signals of a display device according to an exemplary embodiment of the present invention.

First, in a first frame, which is a frame for displaying the moving image, the graphics processing unit 700 transmits the image data DAT of the moving image to the signal controller 600, and the signal controller 600 transmits the gate control signal CONT1 to the gate driver 400 and the image data DAT and the data control signal CONT2 to the data driver 500. In response to the gate control signal CONT1, the image data DAT of the moving image, and the data control signal CONT2, the display panel 300 displays the moving image with the first scan ratio in the first frame. For example, in the case that the first scan ratio is 60 Hz, the image is displayed each $1/60^{th}$ of a second in the first frame.

In other words, the graphics processing unit 700 recognizes the first frame as that of the moving image and supplies the image data DAT of the moving image, and the display panel 300 displays the moving image with the first scan ratio.

As shown in FIG. 2, Input state may refer to the case when the image data DAT is being transmitted to the data driver 500 and Output state may refer to the case when the image data DAT is displayed on the display panel 300.

Next, in a second frame, which is a frame for displaying the still image, the graphics processing unit 700 transmits the image data DAT of the still image to the signal controller 600 along with a still image start signal indicating the start of the display of the still image. The signal controller 600 receives the still image start signal to recognize the start of the display of the still image and stores the image data DAT of the still image in the frame memory. In addition, the signal controller 600 deactivates the graphics processing unit 700 such that the graphics processing unit 700 does not transmit the image data DAT of the still image.

The signal controller 600 transmits the image data DAT of the still image stored in the frame memory to the data driver 500. Here, the display panel 300 displays the still image with the second scan ratio in the second frame. For example, in the case that the second scan ratio is 40 Hz, the image is displayed each $1/40^{th}$ of a second in the second frame.

In other words, in the second frame, the graphics processing unit 700 recognizes the second frame as that of the still image such that the graphics processing unit 700 is deactivated, and the display panel 300 displays the still image with the second scan ratio.

As can be gleaned from the middle of the timing diagram in FIG. 2, the display panel 300 may display the still image with the second scan ratio from a third frame to an (n−1)-th frame like the second frame.

Next, in an n-th frame, which is a frame corresponding to a point where the Input state of the still image is switched to the moving image, the graphics processing unit 700 transmits the image data DAT of the moving image to the signal controller 600 along with a still image finish signal indicating the finish of the display of the still image.

In this case, the display panel 300 is driven with the second scan ratio to the frame just before the n-th frame, and then, in the n-th frame, the graphics processing unit 700 recognizes that the display panel 300 is to be driven with the first scan ratio, and thus, causes the scan ratio to be changed in about the middle of the n-th frame. However, a time delay is generated when the image data DAT of the moving image is transmitted from the graphics processing unit 700. Accordingly, to prevent the deterioration of visibility in the display panel 300 due to this delay, the image data DAT of the still image is displayed with the second scan ratio until the n-th frame in which the still image finish signal is applied ends.

In other words, in a frame in which the moving image is recognized to be displayed, the display panel 300 displays the still image with the second scan ratio up to a vertical blank period at the end of the frame.

Next, in the (n+1)-th frame, which is a frame for displaying the moving image, the graphics processing unit 700 transmits the image data DAT of the moving image to the signal controller 600, and the display panel 300 displays the moving image with the first scan ratio.

Next, a method of driving a display device according to an exemplary embodiment of the present invention will be described with reference to FIG. 1 and FIG. 3.

Figure 3:
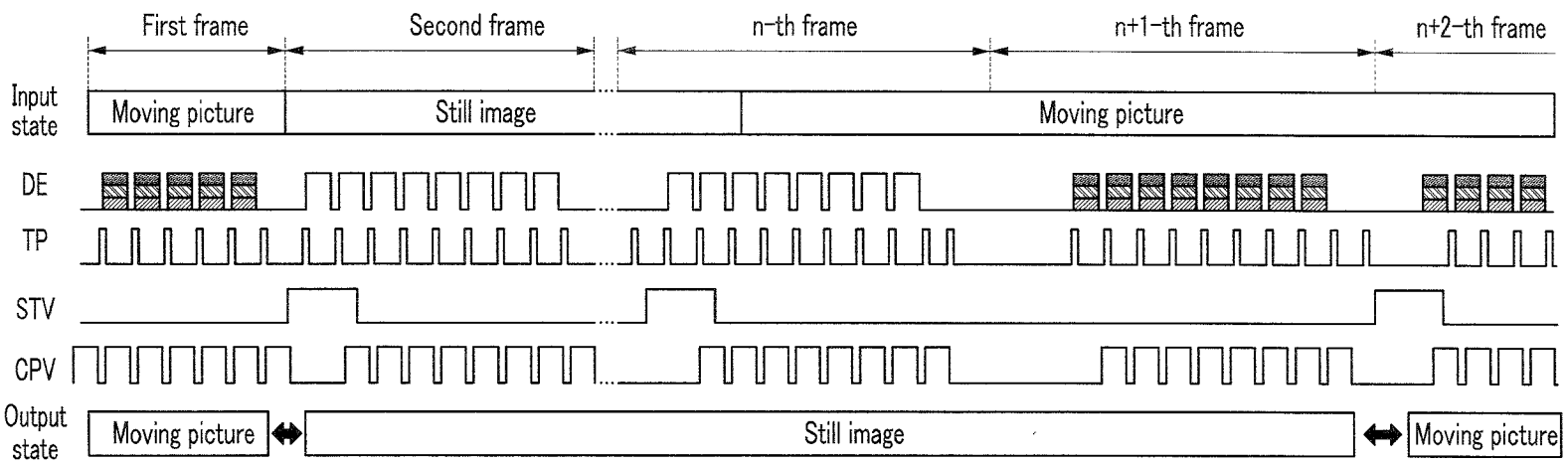
FIG. 3 is a timing diagram of control signals of a display device according to an exemplary embodiment of the present invention.

FIG. 3 is a timing diagram showing control signals of a display device according to an exemplary embodiment of the present invention.

Since the present exemplary embodiment is similar to the method of FIG. 2, parts of the present exemplary embodiment different from the exemplary embodiment of FIG. 2 will be mostly described.

The driving method of the display device in the first frame, the second frame, and the n-th frame in FIG. 3 may be the same as that described above for FIG. 2.

In the (n+1)-th frame, the graphics processing unit 700 recognizes the (n+1)-th frame as a frame for displaying the moving image and transmits the image data DAT of the moving image to the signal controller 600.

The signal controller 600 transmits the STV signal to the gate driver 400 at the start of each frame, and the gate driver 400 then receives the CPV signal from the signal controller 600 to turn on the switching element Q of the display panel 300. However, the signal controller 600 does not transmit the STV signal to the gate driver 400 at the start of the (n+1)-th frame, which is a point where the second scan ratio is changed into the first scan ratio. Accordingly, although the CPV signal is applied to the gate driver 400 in the (n+1)-th frame, since the STV signal is not applied, the switching element Q of the display panel 300 is turned-off.

In other words, the switching element Q is not turned on in the (n+1)-th frame such that the pixel is not newly charged; instead, the voltage charged to the pixel in the n-th frame is maintained, and thus the display panel 300 displays the still image.

Next, in the (n+2)-th frame, which is a frame for displaying the moving image, the graphics processing unit 700 transmits the image data DAT of the moving image to the signal controller 600, and the display panel 300 displays the moving image with the first scan ratio.

In the display device according to an exemplary embodiment of the present invention, the clock signal is changed to change the scan ratio. Next, a clock signal used in a display device according to an exemplary embodiment of the present invention will be described with reference to FIG. 4.

Figure 4:
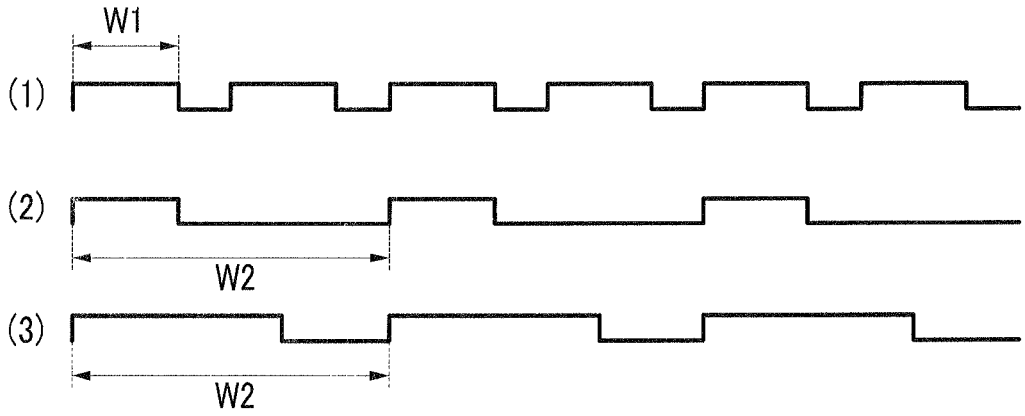
FIG. 4 is a timing diagram of clock signals used in a display device according to an exemplary embodiment of the present invention.

FIG. 4 is a timing diagram showing clock signals used in a display device according to an exemplary embodiment of the present invention.

In the display device according to an exemplary embodiment of the present invention, the display panel 300 is driven with the first scan ratio when displaying the moving image; in this case, the clock signal is shown at the uppermost line (1) in FIG. 4.

In the display device according to an exemplary embodiment of the present invention, when displaying the still image, the display panel 300 is driven with the second scan ratio that is lower than the first scan ratio; in this case, the clock signal is shown at the second and third lines (2) and (3) in FIG. 4.

For example, a width W2 of the clock signal when the display panel 300 is driven with the second scan ratio is greater than a width W1 of the clock signal when the display panel 300 is driven with the first scan ratio. Accordingly, as shown at the second line (2) of FIG. 4, by increasing a blank period, the width of the clock signal may be increased. Alternately, as shown in the third line (3) of FIG. 4, the clock speed of the clock signal when the display panel 300 is driven with the second scan ratio is lower than the clock speed of the clock signal when the display panel 300 is driven with the first scan ratio, thereby increasing the width of the clock signal.

As described above, in the display device according to an exemplary embodiment of the present invention, to drive the still image and the moving image with different scan ratios, different clock signals may be used. Next, the width of the CPV signal according to the size of the clock signals used in the driving of the still image and the moving image will be described with reference to FIG. 5 and FIG. 6.

Figure 5:
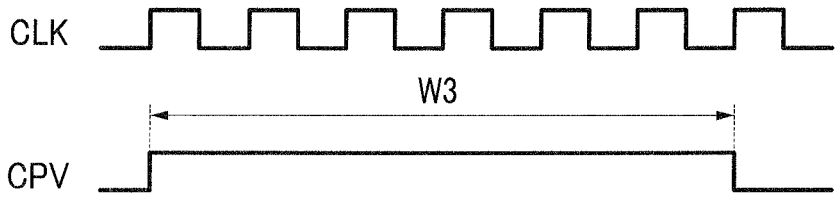
FIG. 5 is a timing diagram showing a clock signal and a gate clock (CPV) signal when displaying a moving image in a display device according to an exemplary embodiment of the present invention.
Figure 6:
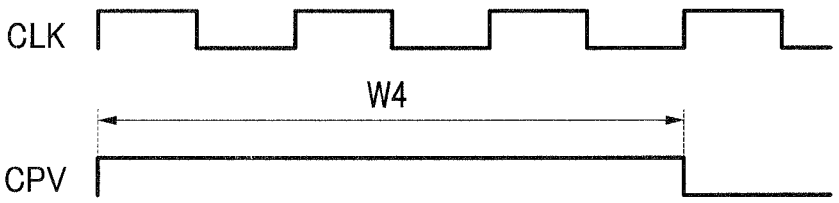
FIG. 6 is a timing diagram showing a clock signal and a CPV signal when displaying a still image in a display device according to an exemplary embodiment of the present invention.

FIG. 5 is a timing diagram showing a clock signal and a CPV signal when displaying a moving image in a display device according to an exemplary embodiment of the present invention, and FIG. 6 is a timing diagram showing a clock signal and a CPV signal when displaying a still image in a display device according to an exemplary embodiment of the present invention. The clock signal is indicated by CLK, and the CPV signal is indicated by CPV.

As shown in FIG. 5, in the display device according to an exemplary embodiment of the present invention, a width W3 of the CPV signal when the display panel 300 is driven with the first scan ratio is six clock signals. If the CPV signal is set to have a six clock signal width when the display panel 300 is driven with the second scan ratio, the clock signal for driving with first scan ratio is different from the clock signal for driving with the second scan ratio such that the width of the CPV signal is changed.

As shown in FIG. 6, in the display device according to an exemplary embodiment of the present invention, a width W4 of the CPV signal when the display panel 300 is driven with the second scan ratio is three clock signals. Accordingly, although the clock speed when the display panel 300 is driven with the second scan ratio is slower than the clock speed when the display panel 300 is driven with the first scan ratio, by differentiating the parameters of the widths of the CPV signals when the display panel 300 is driven with the first scan ratio and the second scan ratio, the widths of the CPV signals may be equally maintained.

In other words, in the signal controller 600, the width W3 of the CPV signal when the display panel 300 is driven with the first scan ratio is set to have the same width as n times the clock signal, and the width W4 of the CPV signal when the display panel 300 is driven with the second scan ratio is set to have the same width as m times clock signal. At this time, n and m may be set so that the width W3 of the CPV signal when the display panel 300 is driven with the first scan ratio and the width W4 of the CPV signal when being driven with the second scan ratio are equal to each other.

Accordingly, a change ratio of the pixel when the display panel 300 displays the still image is the same as a change ratio of the pixel when the display panel 300 displays the moving image such that a difference in visibility caused by the transition from the still image to the moving image may not occur.

Another method of preventing the difference in visibility between the still image and the moving image will be described with reference to FIG. 7.

Figure 7:
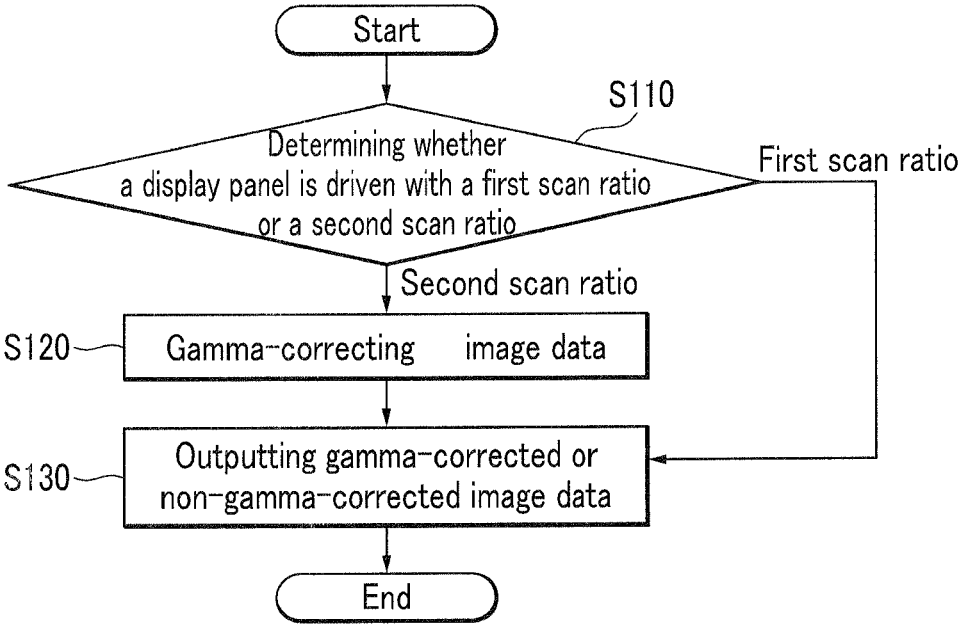
FIG. 7 is a flowchart showing a method of amending image data in a display device according to an exemplary embodiment of the present invention.

FIG. 7 is a flowchart showing a method of amending image data in a display device according to an exemplary embodiment of the present invention.

As shown in FIG. 7, the signal controller 600 determines whether the display panel 300 is to be driven with the first scan ratio or the second scan ratio in a corresponding frame (S110).

At this time, the changing ratios of the pixels are different in a frame driven with the first scan ratio and a frame driven with the second scan ratio such that the images that are actually displayed are different even though the images have the same image data DAT. Accordingly, to compensate for a luminance difference that is generated according to the different changing ratios of the pixels in the frame driven with the first scan ratio and the frame driven with the second scan ratio, if it is determined that the display panel 300 is to be driven with the second scan ratio in S110, the image data of the corresponding frame is gamma corrected (S120).

Next, the image data DAT that is gamma-corrected is output in the frame driven with the second scan ratio (S130). If, however, it is determined that the display panel 300 is to be driven with the first scan ratio in S110, the image data DAT is output without being gamma corrected in the frame driven with the first scan ratio (S130).

In other words, the image data DAT in the frame driven with the second scan ratio is gamma-corrected such that the difference in visibility may not occur even though the changing ratios of the pixels when the display panel 300 displays the still image and the moving image are different.

In accordance with an exemplary embodiment of the present invention, a still image is driven with a scan ratio that is lower that a scan ratio used to drive a moving image, such that power consumption of a display device is reduced. By driving the still image with the scan ratio below a predetermined level, the corresponding decrease in the amount of power consumption may outweigh an increase in the amount of the power consumed by the display device due to the addition of the frame memory.

In accordance with an exemplary embodiment of the present invention, deterioration of visibility due to the change of the scan ratio is prevented by maintaining the display of a still image during a frame in which a still image is changed to a moving image by a graphics processing unit. In addition, even though the scan ratio is changed, since it is set to correspond to the width of the gate clock signal, the deterioration of visibility due to the change of the scan ratio is further prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A display device, comprising:

a display panel displaying a still image and a moving image; and a signal controller controlling signals to drive the display panel, wherein the signal controller includes a frame memory storing image data of the still image and providing the image data to the display panel, and the display panel is driven with a first scan ratio when displaying the moving image and is driven with a second scan ratio that is lower than the first scan ratio when displaying the still image, wherein the display panel includes a gate line and a data line, the display device further includes a gate driver driving the gate line, and a data driver driving the data line, and the signal controller transmits a scanning start (STV) signal and a gate clock (CPV) signal to the gate driver, wherein the signal controller controls a width of the CPV signal to be the same when the display panel is driven with the first scan ratio and the second scan ratio, wherein the signal controller controls the width of the CPV signal to have the same width as a clock signal of n pulses when the display panel is driven with the first scan ratio, and the width of the CPV signal to have the same width as a clock signal of m pulses, which is less than the n pulses, when the display panel is driven with the second scan ratio, wherein n and m are integers greater than 0.

2. The display device of claim 1, further comprising:

a graphics processing unit transmitting image data of the moving image to the signal controller when the moving image is displayed, and transmitting a still image start signal and a still image finish signal to the signal controller.

3. The display device of claim 2, wherein the display panel is driven with the second scan ratio in response to the still image start signal until a frame in which the still image finish signal is applied ends.

4. The display device of claim 3, wherein the signal controller transmits the STV signal to the gate driver at the start of each frame except for a frame where the second scan ratio is changed to the first scan ratio.

5. The display device of claim 4, wherein a first clock signal that is used when the display panel is driven with the second scan ratio has a lower clock speed than a second clock signal that is used when the display panel is driven with the first scan ratio.

6. The display device of claim 4, wherein a first clock signal that is used when the display panel is driven with the second scan ratio has a longer blank period than a second dock signal that is used when the display panel is driven with the first scan ratio.

7. The display device of claim 4, wherein the signal controller gamma-corrects the image data of the still image when the display panel is driven with the second scan ratio and transmits the gamma-corrected image data to the display panel.

8. A method for driving a display device including a display panel displaying a moving image and a still image, and a signal controller controlling signals to drive the display panel, the method comprising:

displaying, at the display panel, the moving image with a first scan ratio;

receiving, at the signal controller, a still image start signal and image data of a still image, and storing the image data of the still image in a frame memory of the signal controller;

supplying, in response to the still image start signal, the image data of the still image stored in the frame memory to the display panel;

displaying, at the display panel, the still image with a second scan ratio that is lower than the first scan ratio; and controlling, with the signal controller, a width of a gate clock (CPV) signal to be the same when the display panel is driven with the second scan ratio and when the display panel is drives with the first scan ratio, wherein the signal controller controls the width of the CPV signal to have the same width as a clock signal of n pulses when the display panel is driven with the first scan ratio, and the width of the CPV signal have the same width as a clock signal of m pulses, which is less than n pulses, when the display panel is driven with the second scan ratio, wherein n and m are integers greater than 0.

9. The method of claim 8, further comprising:

displaying the still image with the second scan ratio at the display panel until a frame in which a still image finish signal is applied ends; and displaying the moving image with the first scan ratio at the display panel in a frame following the frame in which the still image finish signal is applied.

10. The method of claim 9, further comprising:

transmitting, from a graphics processing unit of the display device, image data of the moving image to the signal controller when the moving image is displayed, and deactivating the graphics processing unit when the still image is displayed.

11. The method of claim 10, further comprising:

transmitting, from the signal controller, a scanning start (STV) signal at the start of each frame except for a first frame to be driven with the first scan ratio after the still image finish signal is applied.

12. The method of claim 11, further comprising:

outputting, from the signal controller, a first clock signal when the display panel is driven with the second scan ratio and a second clock signal when the display panel is driven with the first scan ratio, wherein the first clock signal has a lower speed than the second clock signal.

13. The method of claim 11, further comprising:

outputting, from the signal controller, a first clock signal when the display panel is driven with the second scan ratio and a second clock signal when the display panel is driven with the first scan ratio, wherein the first clock signal has a longer blank period than the second clock signal.

14. The method of claim 11, further comprising:

gamma-correcting, with the signal controller, the image data of the still image when the display panel is driven with the second scan ratio and transmitting the gamma-corrected image data to the display panel.

15. A display device, comprising:

a display panel that displays a still image and a moving image;

a signal controller that drives the display panel and includes a frame memory that stores image data of the still image; and a graphics processing unit (GPU) that provides the image data of the still image at a first frame rate to the signal controller and provides image data of the moving image at a second frame rate to the signal controller, wherein, in a first frame in which the GPU switches from the first frame rate to the second frame rate, the image data of the still image is displayed to the end of the first frame, the signal controller controls a width of a gate clock (CPV) signal to be the same when the display panel is driven with the first frame rate and the second frame rate, the signal controller controls the width of the CPV signal to have the same width as a clock signal of n pulses when the display panel is driven with the second frame rate, and the width of the CPV signal to have the same width as a clock signal of m pulses, which is less than the n pulses, when the display panel is with the first frame rate, and wherein n and m are integers greater than 0.

* * * * *